United States Patent [19]

Spengler

[11] 4,088,479

[45] May 9, 1978

[54] HOT CORROSION RESISTANT FABRICABLE ALLOY

[75] Inventor: Charles J. Spengler, Franklin Borough, Pa.

[73] Assignee: Westinghouse Electric Corp., Pittsburgh, Pa.

[21] Appl. No.: 649,773

[22] Filed: Jan. 16, 1976

[51] Int. Cl.[2] ..... C22C 19/05

[52] U.S. Cl. ..... 75/171; 75/134 F; 148/32

[58] Field of Search ..... 75/171, 170, 134 F, 75/176; 148/32, 32.5

[56] References Cited

U.S. PATENT DOCUMENTS

| | | | |
|---|---|---|---|
| 2,134,423 | 10/1938 | Touceda | 75/171 |
| 3,627,511 | 12/1971 | Taylor et al. | 75/171 |
| 3,676,110 | 7/1972 | Mito et al. | 75/171 |
| 3,754,902 | 8/1973 | Boone et al. | 75/171 |
| 3,907,552 | 9/1975 | Kennedy | 75/171 |

*Primary Examiner*—R. Dean

*Attorney, Agent, or Firm*—R. T. Randig

[57] ABSTRACT

An alloy composition highly resistant to hot corrosion attack in combustion atmospheres and possessing good ductility, particularly suited for use as a coating material on gas turbine components. The alloy consists of 25–45% by weight chromium, 0–40% by weight cobalt and balance nickel. The alloy may also include 2.5–5.5% by weight aluminum or 1.0–2.0% by weight silicon and 0.1–1.0% by weight yttrium.

6 Claims, No Drawings

HOT CORROSION RESISTANT FABRICABLE ALLOY

BACKGROUND OF THE INVENTION

This invention relates generally to metal alloys and more particularly to alloy compositions suitable for use in hot, corrosive, combustion atmospheres of the type found in gas turbines. Currently, the high cost of quality fuels for gas turbines has made it economically attractive to use lower quality fuels or to increase the temperature of the gas path of the turbine. These lower quality fuels may contain harmful alkali-sulfates which cause accelerated hot corrosion attack of the hot gas path components of gas turbines. These hot gas path components such as vanes and blades are generally constructed of nickel or cobalt base super alloys. The super alloys, while possessing high strength at high temperatures, are quite prone to the accelerated corrosive effects of the hot gas path.

Heretofore, attempts have been made to replace the super alloy components with corrosion-resistant materials, but these have been unsuccessful because the cast, powder metallurgical, and wrought alloys having the necessary corrosion resistance do not possess sufficient mechanical properties for service in the gas turbine environment. Heretofore, the most successful approach has been to coat the super alloy components with corrosion-resistant materials; however, these have not proven completely successful, either because the built-up or the diffusion types, are limited by coating defects, high brittleness or the great expense of certain platinum group metals. Another approach has been to clean the front end fuel or inlet air of corrosive elements; however, this has proven to be very expensive and lacks versatility to handle diverse fuels. Additives added to the fuels to mitigate the effect of corrosive elements are not only costly, but they result in heavy deposit formations in the hot gas path components of the turbine.

This invention solves many of the problems heretofore encountered in hot corrosive combustion atmospheres by providing an alloy which is highly resistant to hot corrosion attack and which also possesses a high degree of ductility.

SUMMARY OF THE INVENTION

Briefly stated, the inention provides an alloy composition comprising from 25 to 45% by weight chromium, 0 to 40% by weight cobalt and the balance nickel. The alloy may also include from 2.5–5.5% by weight aluminum or 1.0–2.0% by weight silicon and 0.1–1.0% by weight yttrium. The alloy exhibits a very high resistance to the hot corrosion found in combustion atmospheres, and, therefore, may be advantageously used as a coating material for the hot gas path components in gas turbines. The alloy may be applied to the super alloy substrate by several conventional methods, such as physical vapor deposition (electron beam evaporation), ion plating or plasma-arc spraying. This invention also provides an alloy which possesses good ductility, and therefore, the alloy may be fabricated into various shapes. The alloy of this invention can be rolled into thin sheets and thereafter diffusion bonded to suitable substrates, providing corrosion resistance thereto. For applications in very corrosive environments, such as residual-oil fired furnaces, the alloy also can be fabricated directly into support members, hangers and baffles.

DESCRIPTION OF THE PREERRED EMBODIMENTS

A number of corrosion tests were run, the results of which are set forth in the following tables. Test samples were made from the nickel-chromium binary system and from the nickel-chromium-cobalt ternary system, with additions of aluminum or silicon and yttrium. These samples, along with samples of various nickel and cobalt base super alloys were tested in a conventional temperature-cycling burner rig, sometimes referred to as a spinning rig. Corrosion tests were also conducted under dynamic conditions of high temperature, high pressure, high velocity in a turbine simulator test stand. In the following tables, the spinning burner rig tests are designated SR, while the turbine simulator tests are designated with the prefix TS. The test pieces were subjected to the combustion gases of various fuels having varying amounts of corrosive impurities added thereto, such as sodium, vanadium, sulphur, and others.

The alloys set forth in the following tables were evaluated in these corrosion tests in the form of solid alloys machined out of cast stock and also as built-up coatings on nickel and cobalt based super alloys. The coatings were applied by physical vapor deposition (electron beam evaporation) and by plasma arc spraying. The machined test pieces were cylindrical in shape, having a diameter of .250 inches and a length of 2.25 inches. Diameter and radius measurements were taken after each of the tests in order to determine the amount of recession due to hot corrosion. The results of the corrosion tests show that the nickel-chromium binary alloy having 25–45% chromium is highly resistant to attack by alkali sulfate under the isothermal conditions and the optimum range was found to be 35–45% chromium balance nickel. Controlling the chromium within this range also serves to maintain the ductility of the alloy. Under the dynamic combustion gas conditions of the turbine simulator, additions of aluminum and cobalt or silicon and cobalt were found beneficial in order to promote scale retention. The preferable range of cobalt was found to be 20–40% by weight, although smaller amounts may be employed.

The optimum amount of aluminum employed with the cobalt was found to be 2.5–5.5% by weight while the optimum amount of silicon was found to be 1.0–2.0% by weight. The range of cobalt, aluminum and silicon is important because of their combined effect on the hot corrosion resistance and on the mechanical properties of the alloy. Yttrium may also be added in an amount from 0.1–1.0% by weight to promote improved diffusion bonding to nickel base super alloys.

The following tests results indicate the improved hot corrosion resistance of the alloys of this invention.

| Test No. | Alloy | Diameter Recession Inches | Hours |
|---|---|---|---|
| SR-3 | X-45 | .0144 | 1680 |
| | U-500 | .0203 | 1680 |
| 1650° F(899° C) | U-710 | .0152 | 1680 |
| | IN-738 | .0159 | 1680 |
| Gulf Diesel #2 | Mar-M509 | .0166 | 1680 |
| 5ppm Na, 0–6 ppm Mg | Ni-40 Cr bulk EB | .0075 | 1680 |
| 2ppm V, 0.5w/o S | Ni-40Cr cast | .0033 | 1680 |
| 4–5 ppm Ba | Ni-50 Cr cast | .0052 | 1680 |
| | Ni-20 Co-30Cr | .0067 | 1634 |
| | Ni-20 Co-40Cr | .0032 | 1634 |
| | Ni-20 Co-50Cr | .0017 | 1634 |
| | Ni-40Cr-4Al | .0064 | 1641 |
| | Ni-40Cr-2Al | .0155 | 1641 |
| | Ni-40Cr-6Al | .0036 | 1641 |

-continued

| | | | |
|---|---|---|---|
| | Ni-50Cr-4Al | .0131 | 1641 |
| | Ni-50Cr-2Al | .0168 | 1641 |
| | Ni-30Cr-1.5 Si | .0164 | 1641 |
| | Ni-30Cr-4Al | .0463 | 1641 |
| | Ni-30Cr-6Al | .0282 | 1641 |
| | Ni-40 Co-30Cr | .0084 | 1634 |
| | Ni-40 Co-40Cr | .0022 | 1634 |
| SR-4 | X-45 | .0334 | 1400 |
| | U-500 | .0382 | 1400 |
| 1650° F(899° C) | U-710 | .0331 | 1400 |
| Gulf Diesel #2 | IN-738 | .0335 | 1400 |
| 50 ppm Na, | Ni-50Cr | .0112 | 1400 |
| 6 ppm Mg | Ni-40Cr | .0098 | 1400 |
| 20 ppm V | Ni-30Cr | .0147 | 1400 |
| 0.5 w/o S | Ni-40Co-40Cr | .0124 | 1400 |
| 4–5 ppm Ba | Ni-20 Co-40Cr | .0169 | 1400 |
| | Ni-50Cr-4Al | .0117 | 1400 |
| | Ni-50Cr-2Al | .0105 | 1400 |
| SR-5 | B-1900 | .0077 | 458 |
| | HA-188 | .0316 | 980 |
| No contaminants | Ni-30Cr-1.5Si | .0031 | 352 |
| | Ni-30Cr-2Al | .0011 | 458 |
| | Ni-40Cr-2Al | .0171 | 563 |
| | Ni-50Cr-2Al | .0030 | 458 |
| | Ni-50Cr-4Al | .0009 | 458 |
| Sr-7 | U-520 | .0040 | 233 |
| | IN-738 | .0174 | 200 |
| 1800° F(982° C) | Mar-M509 | .0074 | 200 |
| Exxon-260 | U-710 | .0158 | 200 |
| 100 ppm Na | Mar-M509 | .0205 | 1094 |
| 12 ppm Mg | Ni-40Cr | .0064 | 1583 |
| 0.5 w/o S | Ni-20Co-40Cr-1.5 Si | .0088 | 652 |
| | Ni-20Co-40Cr-4Al | .0109 | 652 |
| | Ni-20Co-40Cr-4Al | .0062 | 233 |
| | Ni-20C0-40Cr-1.5 Si | .0041 | 233 |
| | Ni-50Cr-4Al | .0065 | 787 |
| | Ni-40Cr-6Al | .0112 | 787 |
| | Ni-40Cr-4Al | .0050 | 787 |
| | Ni-20Co-40Cr-4Al PVD | .0011 | 233 |
| | Ni-20Co-40Cr-4Al PVD | .0019 | 522 |

| Test No. | Alloy | Wt. Loss mg $cm^{-2}$ | Hours |
|---|---|---|---|
| SR-8 | Ni-40Cr PVD | 2.0 | 436 |
| | CoCrAlY PVD | 2.4 | 436 |
| 1450° F (788° C) | Ni-20 Co-40Cr-1.5 | | |
| Exxon Diesel #2 | SiPVD | 3.6 | 436 |
| | Ni-20Co-40Cr-4Al | | |
| 12 ppm Mg | plasma | 9.3 | 436 |
| 12 ppm Cl | Ni-20Co-40Cr-1.5 | | |
| 0.5 w/o S | Si plasma | 11.2 | 436 |
| 0.9 ppm V | Mar-M509 | 16.9 | 436 |
| 1.1 ppm Pb | Udimet-520 | 37.2 | 436 |

Diameter Recession

| Test No. | Alloy | Inches | Hours |
|---|---|---|---|
| TS-6 | | | |
| 1650° F (899° C) | X-45 | .0138 | 102.5 |
| Gulf Diesel | U-500 | .0123 | 102.5 |
| 5 ppm Na | Ni-40Cr | .0034 | 102.5 |
| 0.6 ppm Mg | | | |
| 0.5 w/o S | | | |
| TS-7 | | | |
| 1650° F (899° C) | X-45 | .0075 | 125 |
| Gulf Diesel #2 | Ni-40Cr | .0061 | 100 |
| 5 ppm Na, | | | |
| 0.6 ppm Mg | | | |
| 0.5 w/o S, 4–5 | | | |
| ppm Pb | | | |

Radius Recession

| | Alloy | Inches | Hours |
|---|---|---|---|
| TS-9 | | | |
| 1650° F (899° C) | X-45 | .0147 | 400 |
| Gulf Diesel #2 | U-500 | .0211 | 250 |
| 5 ppm Na, | IN-738 | .0110 | 137 |
| 2 ppm V, | Ni-40Cr X-45 | .0080 | 400 |
| 4–5, ppm Ba, | Ni-40Cr U-500 | .0075 | 400 |
| 0.5 w/o S | Ni-40Cr bulk | .0055 | 400 |
| TS-12 | | | |
| Natural Gas | Ni-40Cr bulk | .0034 | 300 |
| 1650° F (899° C) | | | |
| TS-10 | | | |
| Natural Gas | X-45 | .0034 | 297.5 |
| 1650° F (899° C) | U-500 | .0028 | 297.5 |
| TS-11 | | | |
| Natural Gas | HA-188 | .0035 | 300 |
| 1650° F (899° C) | C-263 | .0039 | 300 |

Radius Recession

| Test No. | Alloy | Inches | Hours |
|---|---|---|---|
| TS-13 | | | |
| 1800° F (982° C) | X-45 | .0052 | 150 |

-continued

| | | | |
|---|---|---|---|
| Gulf | U-500 | .0151 | 150 |
| 2 | | | |
| .5 ppm Na | Mar-M509 | .0133 | 150 |
| .5 ppm V | Ni-40Cr bulk | .0018 | 158 |
| 4–5 ppm Ba | | | |
| .5 w/o S | | | |
| TS-15 | | | |
| 1650° F (899° C) | X-45 | .0050 | 153 |
| Exxon 260 | Mar-M509 | .0031 | 153 |
| 10 ppm Na | Udimet-500 | .0027 | 153 |
| 1 ppm Cl | Ni-40Cr bulk | .0005 | 144 |
| 1.3 ppm Mg | Ni-40Cr | | |
| 0.4 ppm Ca | X-45 PVD | .0018 | 144 |
| 0.4 ppm K | Ni-40Cr | | |
| 5.0 w/o S | U-710 PVD | .0021 | 144 |
| | CoCrAlY | | |
| | X-45 PVD | .0034 | 144 |
| TS-17 | | | |
| 1650° F (899° C) | X-45 | .0090 | 150 |
| Exxon 260 | U-520 | .0058 | 150 |
| 10 ppm Na | CoCrAlY/ | | |
| 18 ppm Cl | MM509 PVD | .0011 | 150 |
| 1.3 ppm Mg | Ni-20Co-40Cr- | | |
| 0.4 ppm Ca | 4Al/MM509 | .0019 | 150 |
| 0.4 ppm K | | | |
| 0.5 w/o S | | | |
| TS-19 | | | |
| 1550° F (843° C) | X-45 | .0052 | 150 |
| Exxon 260 | U-520 | .0024 | 150 |
| 10 ppm Na | CoCrAlY | | |
| 18 ppm Cl | U-520 PVD | .0010 | 150 |
| 1.3 ppm Mg | Ni-20Co-40Cr- | | |
| 0.4 ppm Ca | 4Al U-500 PVD | .0007 | 150 |
| 0.4 ppm V | | | |
| 0.5 w/o S | | | |
| TS-20 | | | |
| 1650° F (899° C) | X-45 | .0027 | 300 |
| 10 ppm Na | U-520 | .0061 | 163 |
| 18 ppm Cl | Ni-20Co-40Cr- | | |
| 1.3 mm Mg | 4Al-.3Y | .0007 | 163 |
| 0.4 ppm Ea | Ni-20Co-40Cr- | | |
| 0.4 ppm K | 1.5 Si | .0012 | 300 |
| 0.5 w/o S | Ni-20Co-40Cr- | | |
| | 4Al-.3Y | .0029 | 300 |
| | Ni-20Co-40Cr- | | |
| | 1.5 Si | .0027 | 300 |

The alloy compositions of this invention, when applied by physical vapor deposition, and subsequently subjected to heat treatments precribed for the substrates, do not exhibit the columnar microstructure which is characteristic of prior corrosion-resistant compositions. If desired, the alloy coatings of this invention may be processed by glass-bead peening and diffusion-heat treatment to produce a recrystallized structure. It is, however, not necessary to treat the compositions of this invention with shot or glass bead peening in order to promote a recrystallized grain structure.

In addition to their utility as coating materials, the alloys of this invention, due to their high degree of ductility, can be rolled into sheet and thereafter diffusion-bonded to suitable substrates. These compositions may also be employed in conventional powder metallurgical techniques and used as a matrix for wire reinforced structural components for gas turbines. Suitable diffusion coatings on the high strength reinforcing wires may be employed to prevent reaction between the non-corrosion-resistant matrix alloy and the reinforcing wires.

The alloy compositions of this invention are much more easily fabricated than the prior, brittle hot corrosion-resistant compositions of the cobalt-chromium-aluminum-yttrium variety. As a result, the alloys of this invention can be made into various complicated shapes, one example of which is a structure that is transpiration cooled, either with air or water. Such structures are used in hot gas path devices where the component must be cooled. The alloy may be rolled into sheet, electroetched, diffusion-bonded and formed into the transpiration cooled device, thus eliminating the need for a protective coating thereon.

What is claimed is:

1. A corrosion-resistant, high-temperature alloy consisting essentially in percent by weight of:

chromium; 25–45
cobalt; 20–40
aluminum; 2.5–5.5
nickel; balance, the said alloy having high fabricability enabling said alloy to be formed into thin sheets and wire.

2. A corrosion-resistant, high-temperature alloy consisting essentially in percent by weight of:

chromium; 25–45
cobalt; 20 –40
silicon; 1.0–2.0
nickel; balance, the said alloy having high fabricability enabling said alloy to be formed into thin sheets and wire.

3. A corrosion-resistant, high-temperature alloy consisting essentially in percent by weight of:

chromium; 35 –45
cobalt; 20–40
aluminum; 2.5–5.5
yttrium; 0.1–1.0
nickel; balance, the said alloy having high fabricability enabling said alloy to be formed into thin sheets and wire.

4. A corrosion-resistant, high-temperature alloy consisting essentially in percent by weight of:

chromium; 35–45
cobalt; 24–40
silicon; 1.0–2.0
yttrim; 0.1–1.0
nickel; balance, the said alloy having high fabricability enabling said alloy to be formed into thin sheets and wire.

5. The alloy of claim 1 including 0.1–1.0 percent by weight yttrium.

6. The alloy of claim 2 including 0.1–1.0 percent by weight yttrium.

* * * * *